US005119839A

United States Patent [19]

Rudolph

[11] Patent Number: 5,119,839

[45] Date of Patent: Jun. 9, 1992

[54] METHOD AND DEVICE FOR STRENGTHENING NAILS USING CARNAUBA WAX

[76] Inventor: James M. Rudolph, 1415 W. La Serena, Brea, Calif. 92621

[21] Appl. No.: 701,475

[22] Filed: May 16, 1991

[51] Int. Cl.[5] ..... A45D 24/00

[52] U.S. Cl. ..... 132/200; 132/73; 132/76.5

[58] Field of Search ..... 132/200, 73, 76.4, 76.5, 132/73.5

[56] References Cited

U.S. PATENT DOCUMENTS

| | | | |
|---|---|---|---|
| 4,049,010 | 9/1977 | Mitchell et al. | 132/76.2 X |
| 4,381,792 | 5/1983 | Busch, Jr. et al. | 132/75.6 |
| 4,764,362 | 8/1988 | Barchas | 424/61 |

*Primary Examiner*—John J. Wilson
*Assistant Examiner*—Jeffrey A. Smith
*Attorney, Agent, or Firm*—John J. Connors

[57] ABSTRACT

Disclosed is a method of sealing a human nail by applying a sealing material such as carnauba wax to the top of the nail using an applicator having a surface to which the sealing material adheres. The sealing material is released by rubbing the surface against the top of the nail to coat it with a thin layer of the sealing material.

8 Claims, 1 Drawing Sheet

METHOD AND DEVICE FOR STRENGTHENING NAILS USING CARNAUBA WAX

BACKGROUND OF THE INVENTION

1. Field of the Invention

This invention relates to a method and applicator device for improving the appearance and strength of human finger and toenails.

2. Background Discussion

Human finger and toenails as an individual ages tend to become brittle and easily split, crack and break. The principle reason for this is the loss of natural oils from the finger and toenails. The application of a film of nail polish does not prevent this loss of oils and splitting, cracking and breaking thus occurs.

SUMMARY OF THE INVENTION

It is the objective of this invention to provide a method and applicator device for improving the appearance and strength of nails and, in particular, to seal the nails with a sealing material such as wax. The preferred wax is a natural occurring substance, carnauba wax.

In accordance with this invention, an applicator is provided which carries the sealing material on a generally flat, planar surface of the applicator. Rubbing or buffing the nails with the applicator causes the sealing material to soften and be released from the applicator and deposited as a thin layer to the top surface of the nails. This sealing material coats the top surface of the nails, providing a barrier which prevents substantial loss of natural oils. This sealing layer improves the appearance of nails and conditions the top nail surface so that the nail polish tends to adhere longer. The sealing layer also makes it difficult for an individual to bite his or her nails.

The device of this invention has several features, no single one of which is solely responsible for its desirable attributes. Without limiting the scope of this invention as expressed by the claims which follow, its more prominent features will now be discussed in the section of this application entitled, "DETAILED DESCRIPTION OF THE PREFERRED EMBODIMENT." After considering this preferred embodiment of the invention, one will understand how its features provide its advantages, which include simplicity of use and stronger better looking finger and toenails.

DESCRIPTION OF THE DRAWING

The preferred embodiment of this invention, illustrating all its features, is shown in the accompanying drawing, which is for illustrative purposes only. This embodiment depicts the novel and non-obvious method and device of this invention. This drawing includes the following figures (FIGS.), with like numerals indicating like parts.

DESCRIPTION OF THE PREFERRED EMBODIMENT

Figure 1:
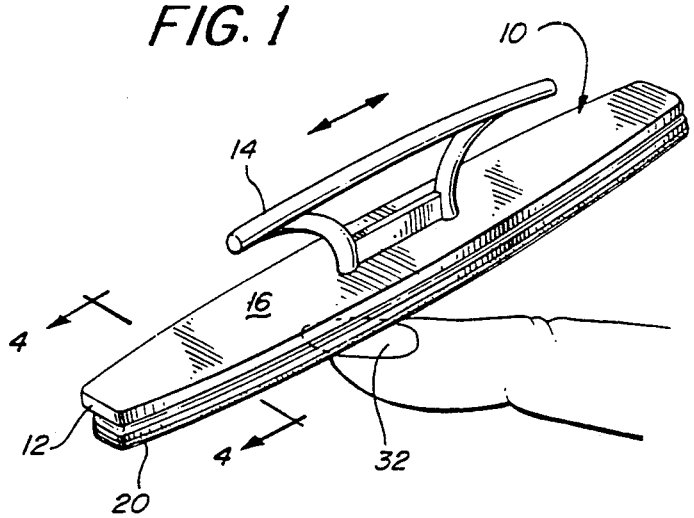
FIG. 1 is a perspective view of the applicator device of this invention being used to apply a thin coating of a sealing material to the top of a finger nail.
Figure 2:
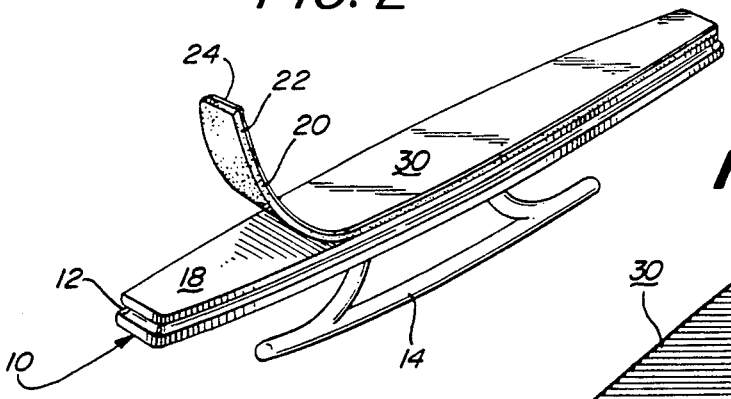
FIG. 2 is an inverted perspective view of the applicator device of this invention, showing the underside surface of the applicator device.
Figure 3:
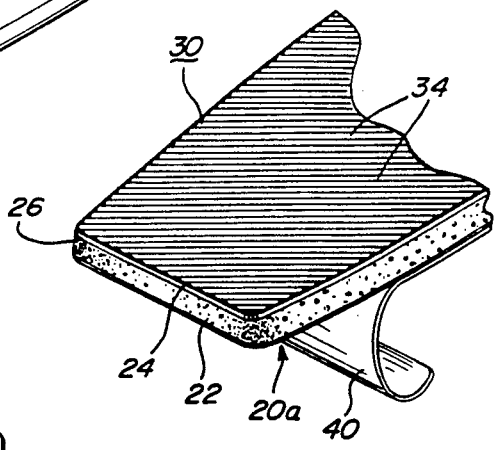
FIG. 3 is an enlarged, fragmentary perspective view of a segment of the sheet material carrying sealing material.
Figure 4:
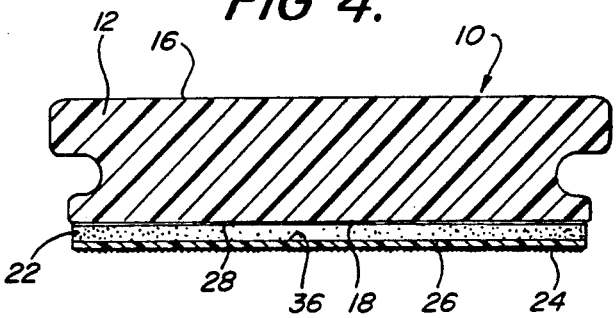
FIG. 4 is a cross-sectional view taken along line 4—4 of FIG. 1.

As illustrated in FIGS. 1 through 3, the applicator device 10 of this invention includes an elongated base 12 having integral therewith a centrally located handle 14 which extends outwardly from the top surface 16 of the base. The base 12 is preferably made by conventional injection molding techniques of a polymeric material such as polystyrene. The underside of the base 12 is a generally flat, smooth, planar surface 18. Adhering to this underside surface 18 is a sheet 20, which has an oblong or oval-like shape that is co-extensive with the underside surface 18. It comprises a foam backing 22 having a thin, polymeric film 24 bonded to the outer side 26 of the foam backing. The inner side 28 of the foam backing 22 is covered with a low tack adhesive to enable the sheet 20 to be removed from the underside surface 18 and replaced. The adhesive-bearing, inner side 28 of the foam backing 22 is sufficiently tacky to hold the sheet 20 to the underside surface 18, but allows the sheet to be easily peeled away. Thus, a used sheet can be replaced with a new one as required. FIG. 3 depicts a replacement sheet **20*a* with a cover 40 that is peeled away to expose the adhesive surface on the inner side 28 of the foam backing 22. One simply aligns the replacement sheet 20*a* with the underside surface 18 of the base 12** and presses the adhesive surface against this underside surface to fix the replacement sheet to the base.

The film 24 has adhering to its exposed surface 30 a thin layer of a sealing material such as carnauba wax. The wax is released upon pressing the film 24 against a finger nail 32 and rubbing or buffing the nail in a conventional manner. Upon rubbing or buffing the finger nail 32, the sealing material softens and is released and deposited as a thin layer on the top surface of the finger nail 32. The film 24 is preferably obtained from 3M Corporation and is identified as Mylar, a polyester lapping film. It has an abrasive surface on one side with ½ micron roughness.

The technique for applying the wax to the film 24 calls for simply melting the wax and dipping the film into the molten wax prior to bonding the internal surface 36 of the film to the outside 26 of the foam backing 22. Upon withdrawal of the film 24 from the molten wax, a liquid wax layer adheres to the exposed surface 30 and the internal surface 36 which solidifies immediately upon withdrawal of the film from the molten wax. The surface 30 is serrated to provide shallow grooves or cavities 34 which are filled by the wax. The depth of the cavities 34 ranges between about ½ and about 2 microns. Initially, a relatively thick layer of wax forms on both the serrated surface 30 and the internal surface 36 of the film 24. Upon flexing the film 24, excess wax flakes off surfaces 30 and 36 of the film 24, but wax remains within the cavities 34. This excess wax may be reused. The wax in the cavities 34 is released upon rubbing the surface 30 of the film 24 across the surface of the finger nail 32 to deposit a thin layer of wax on the exterior surface of the finger nail having a thickness of about ½ micron. This thin layer of wax is sufficient to seal the nail and prevents or impedes the rapid loss of the natural oils from the finger nail.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

I claim:

1. A method of sealing a human nail comprising applying a sealing material consisting essentially of carnauba wax to the top of the nail using an applicator member having a surface to which the carnauba wax adheres, said carnauba wax being released by rubbing said surface against the top of the nail to coat said top of the nail with a thin layer of the carnauba wax.

2. The method of claim 1 wherein the surface has cavities therein which are filled with the carnauba wax and the rubbing of the top of the nail with the applicator causes the wax to soften and be transferred to the top of the nails, sealing said nail with a thin layer of said wax.

3. The method of claim 2 wherein the surface is formed in a sheet of polymeric material supported on a foam backing.

4. An applicator for applying a sealing material to human nails, including an elongated, rigid, support element having a generally flat, planar surface, a foam strip removably attached to the planar surface, said foam strip having on one side an adhesive surface which adheres to said planar surface and another side which has a thin layer of a polymeric material bonded thereto, said polymeric material having an exposed surface holding a sealing material consisting essentially of carnauba wax which is released upon rubbing against the top of a nail.

5. The applicator of claim 4 wherein the adhesive surface is of the low tack type so that the foam strip, including the polymeric material, is removably attached to the planar surface.

6. An applicator for applying a sealing material to human nails, including an elongated, rigid, support element having a generally flat, planar surface, said surface holding a sealing material consisting essentially of carnauba wax which is released and adheres to the top of a nail upon rubbing against said top of said nail.

7. An applicator for applying a sealing material to a human nail, including an elongated, rigid, support element having a generally flat, planar surface with cavities therein which are filled with a sealing material consisting essentially of carnauba wax which softens upon rubbing of the top of the nail and said surface against each other to cause the carnauba wax to soften and be transferred to the top of the nail, sealing said nail with a thin layer of said carnauba wax.

8. The applicator of claim 7 wherein the cavities have a depth ranging between ½ and 2 microns.

* * * * *